US006805789B2

(12) United States Patent
Srinivasan et al.

(10) Patent No.: US 6,805,789 B2
(45) Date of Patent: Oct. 19, 2004

(54) METHODS OF PRODUCING ELECTRODES AND METHODS OF USING SUCH ELECTRODES TO ACCUMULATE AND DETECT ANALYTES

(75) Inventors: Rengaswamy Srinivasan, Ellicott City, MD (US); Hassan M. Saffarian, Silver Spring, MD (US); Peter F. Scholl, Silver Spring, MD (US); Plamen A. Demirev, Ellicott City, MD (US); Andrew B. Feldman, Columbia, MD (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 10/640,984

(22) Filed: Aug. 14, 2003

(65) Prior Publication Data

US 2004/0099536 A1 May 27, 2004

Related U.S. Application Data

(60) Provisional application No. 60/405,270, filed on Aug. 22, 2002.

(51) Int. Cl.[7] ..... G01N 27/327; G01N 27/38; B01D 59/44

(52) U.S. Cl. ..... 205/792; 205/705; 250/282

(58) Field of Search ..... 205/705, 777.5, 205/792; 250/282–284

(56) References Cited

U.S. PATENT DOCUMENTS

| | | | | |
|---|---|---|---|---|
| 3,751,340 A | | 8/1973 | Witz | 435/27 |
| 4,541,908 A | | 9/1985 | Niki et al. | 503/206 |
| 4,983,516 A | | 1/1991 | Turner et al. | 435/34 |
| 5,466,589 A | | 11/1995 | Olinger et al. | 435/174 |
| 5,827,417 A | * | 10/1998 | Porter et al. | 204/489 |

FOREIGN PATENT DOCUMENTS

| | | | |
|---|---|---|---|
| DE | 0699901 | 3/1996 | G01N/29/02 |
| JP | 3045632 | 2/1991 | C08J/5/18 |

OTHER PUBLICATIONS

Black et al. ("Synthesis of a Rigid Dimethoxynaphtahalene–Spacer–Dithiol Which Spontaneously attaches to Au and Pt Electrodes: Properties of Monolayer Films in NonAqueous Solvents," J. Am. Chem. Soc. 1993, 115, 7924–7925).*

Maskus et al., ("Synthesis and Characterization of Redox–Active Metal Complexes Sequentially Self–Assembled onto Gold Electrodes via a New Thiol–Terpyridine Ligand," Langmuir 1996, 12, 4455–4462).*

Electrochemical Properties of Nile Blue Covalently Immobilized on Self–Assembled Thiol–Monolayer Modified Gold Electrodes, Liu et al., Analytical Sciences, Dec. 2002, vol. 18.

Bio Sensors and Novel Bioanalytical Methods, Biochemical Society Transactions (2000) vol. 28, Part 2, 2000 Biochemical Society.

Adsorption Preconcentration for the Direct Analytical Determination of Heme, Kolpin et al., Analytical Chemistry, vol. 50, No. 7, Jun. 1978.

* cited by examiner

*Primary Examiner*—Alex Noguerola
(74) *Attorney, Agent, or Firm*—Francis A. Cooch

(57) ABSTRACT

Provided are methods of producing an electrode capable of binding an analyte thereto comprising: providing a substrate capable of binding a dithiol molecule thereto; electrochemically treating the substrate using cyclic voltammetry to provide a treated substrate having a fractal dimension of greater than about 2; and contacting the treated substrate with dithiol molecules to produce an electrode having dithiol groups attached thereto and capable of binding an analyte to be detected thereto. Also provided are methods of accumulating and detecting analytes using the electrodes produced via the methods of the present invention.

33 Claims, 5 Drawing Sheets

METHODS OF PRODUCING ELECTRODES AND METHODS OF USING SUCH ELECTRODES TO ACCUMULATE AND DETECT ANALYTES

CROSS-REFERENCE TO RELATED APPLICATIONS

The present application claims the benefit of prior filed Provisional Application No. 60/405,270 which was filed with the United States Patent and Trademark Office on Aug. 22, 2002. The entire disclosure of the above-referenced application is incorporated herein by reference.

BACKGROUND OF THE INVENTION

1. Field of the Invention

The present invention relates generally to methods of producing electrodes for the accumulation detection of thiol-binding analytes. More specifically, the present invention describes the production of analyte-accumulating electrodes having dithiol groups attached thereto, and methods for using such electrodes to accumulate and detect thiol-binding analytes in target samples.

2. Description of the Related Art

Methods and apparatus for the efficient and accurate detection and quantification of thiol-binding analyte levels in target samples are of particular interest for use in a wide range of applications. For example, the effective and efficient detection of heme or hemoglobin in human feces, i.e. fecal occult blood (FOB) detection, is of significant interest in the diagnosis of colorectal cancer. Colorectal cancer has an annual worldwide incidence of more than 600,000 cases and is the third most common human cancer. It has been reported as being the second leading cause of death in North America (Lieberman, et al. "Use of Colonoscopy to screen Asymptomatic Adults for Colorectal Cancer," *New England Journal of Medicine,* 343, 162–168 (2000)). Among those over 45 years of age, 10% have colorectal polyps of which 1% will become malignant. Early detection of these lesions increases patient survival rates. Id. The presence of heme or hemoglobin in the feces is an indication of bleeding colon polyps which are a known risk factor for the developments of colon cancer. By monitoring the levels of heme of human feces, the early detection and treatment of colorectal cancer is more readily achieved.

Other applications for the accumulation and detection of heme include the diagnosis of malarial infection. Malaria infections can result in the accumulation of heme in infected red blood cells. By monitoring the accumulation of heme in red blood cells, the early detection of malarial infections can be achieved.

Several methods for the detection of heme in a sample are available commercially and used clinically. For example, fecal occult blood detection methods are available under the tradenames Hemoccult II and Hemoccult II SENSA from Smith Kline Diagnostic, Palo Alto, Calif., and immunochemical detection methods are available under the tradenames Hemeselect and FlexSure OBT. Unfortunately, such methods tend to lack the desired sensitivity and specificity to avoid high false positive detection rates for fecal occult blood.

Other methods for accumulating thiol-binding analytes such as iron protoporphyrin and iron hematoporphyrin using dimercaptoalkane-modified solid wire or plate gold electrodes have been disclosed in "Electrochemistry of Self-Assembled Monolayers of Iron Protoporphyrin IX Attached to Modified Gold Electrodes through Thioether Linkage" D. L. Pilloud, et al., *J. Phys. Chem. B* 2000, 104, 2868–2877, incorporated herein by reference. However, as discussed by Pilloud, the electrodes produce for use therein are disadvantageous in that the thiolated electrode surfaces tend to degrade relatively rapidly when the electrodes are left in contact with air or immersed in aqueous solution. Id. at 2869. Accordingly, such methods are unsuitable for producing electrodes capable of accumulating analytes for relatively long periods of time (for example one or more days) and capable of being transported in air or water for any significant period of time.

SUMMARY OF THE INVENTION

The present invention overcomes the aforementioned disadvantages by providing methods of producing electrodes comprising stable thiolated surfaces, and methods of using such electrodes to accumulate and detect thiol-binding analytes, especially heme, in a target sample with high degree of sensitivity and selectivity. In particular, applicants have discovered that the thiolated surfaces of the electrodes produced via the present inventions tend to be advantageously stable, i.e. avoid significant degradation, for periods of time as long as several hours to one or more days (or longer) either in the presence or absence of oxygen. Although applicants do not wish to be bound by or to any particular theory of operation, it is believed that the present methods provide electrodes which overcome the relative instability of prior art electrodes in the presence of oxygen by preparing the electrode surface through an electrochemical treatment prior to thiolating the surface. Tests were conducted which comprised aerating a target sample solution comprising heme and introducing an electrode of the present invention thereto. The tests showed that heme was as easily attached to the electrode in such solution as it is in specially de-aerated solutions, suggesting that the bonds formed between dithiol molecules and the electrode substrate according to the present methods do not readily break in the presence of oxygen.

Because of the aforementioned surface stability, the electrodes produced herein can be used advantageously according to the present invention to accumulate and detect amounts of thiol-binding analytes from low concentration analyte solutions with greater accuracy than prior art electrode processes. To ensure sufficient interaction of thiol-binding analyte molecules in relatively low concentration analyte solutions (for example, those having a concentration measured in nanomolar (nM) or even smaller units) with an electrode for the concentration and accurate detection thereof, it is often necessary to allow the electrode to remain in the target analyte solution for a period of time as long as several hours to one or more days. While many prior art electrodes tend to degrade before such necessary interaction times are achieved, the electrodes produced herein tend to be sufficiently stable to remain in solution for periods of time necessary to measure low analyte concentrations with an accuracy not previously achievable using prior art methods. Applicants have recognized, for example, that the electrode of the present invention can be used to detect thiol-binding analytes in solutions comprising an analyte concentration of greater or less than about 100 micromolar ($\mu$M). In certain embodiments, the present methods can be used to detect analytes in solutions as low as from about 10 nM to about 100 $\mu$M of analytes. Preferably, the present methods are capable of detecting analytes in solution comprising concentrations as low as less than about 10 nM analytes, and even more preferably less than about 1 nM analytes.

Applicants have further recognized that the electrodes having analyte accumulated thereon produced according to the present methods tend to be sufficiently stable to allow the electrode to be transferred from a sample solution to a test solution for use in analyte detection. By concentrating analyte samples onto an electrode and/or transferring the analyte into another solution, the present methods allow for a more sensitive, selective, and accurate detection of low analyte concentrations in sample solutions than is obtainable using prior art electrode methods. In addition, the accumulated-analyte electrodes can be transported in air or aqueous solution from, for example, a field testing site to the laboratory for analysis. This obviates the need to transport entire liquid samples, such as blood samples, which may require refrigeration or other handling and transport considerations, for testing to the laboratory.

According to certain embodiments of the present methods, applicants have also recognized that the production and use of electrodes having a fractal dimension ($D_f$) of greater than about 2 allows for the detection of analytes in solution with greater sensitivity than prior art methods. As will be recognized by those of skill in the art, the term "fractal dimension" refers to a measurement of fractal geometric dimension. For example, a metal electrode with a flat surface has a $D_f$=2. As discussed below, certain metal electrodes comprising coiled metal wires (in some cases with surfaces roughened via cyclic voltammetry) produced via the present methods have $D_f$ values of greater than 2. By using electrodes having $D_f$>2, certain preferred embodiments of the present invention allow for the binding of greater amounts of dithiol compounds, and thus, greater amounts of analyte, to the electrode for the detection of analyte with greater accuracy and sensitivity than prior art methods.

According to one aspect, the present invention provides methods of producing an electrode comprising: providing a substrate capable of binding a dithiol molecule thereto; electrochemically treating the substrate to provide a treated substrate having a fractal dimension of greater than about 2; and contacting the treated substrate with dithiol molecules to produce an electrode having dithiol groups attached thereto and capable of binding an analyte thereto.

According to another aspect, the present invention comprises methods of accumulating an analyte capable of bonding to a dithiol moiety onto an electrode comprising: providing an electrode of the present invention capable of binding the analyte to be detected thereto; and contacting the electrode with a target solution comprising an analyte to bind at least a portion of the analyte to the electrode.

According to yet another aspect, the present invention provides methods of detecting analytes in a target solution comprising: providing an electrode of the present invention capable of binding the analyte to be detected thereto; contacting the electrode with a target solution comprising an analyte to bind at least a portion of the analyte to the electrode; and detecting the analyte on the electrode.

DETAILED DESCRIPTION

Figure 1:
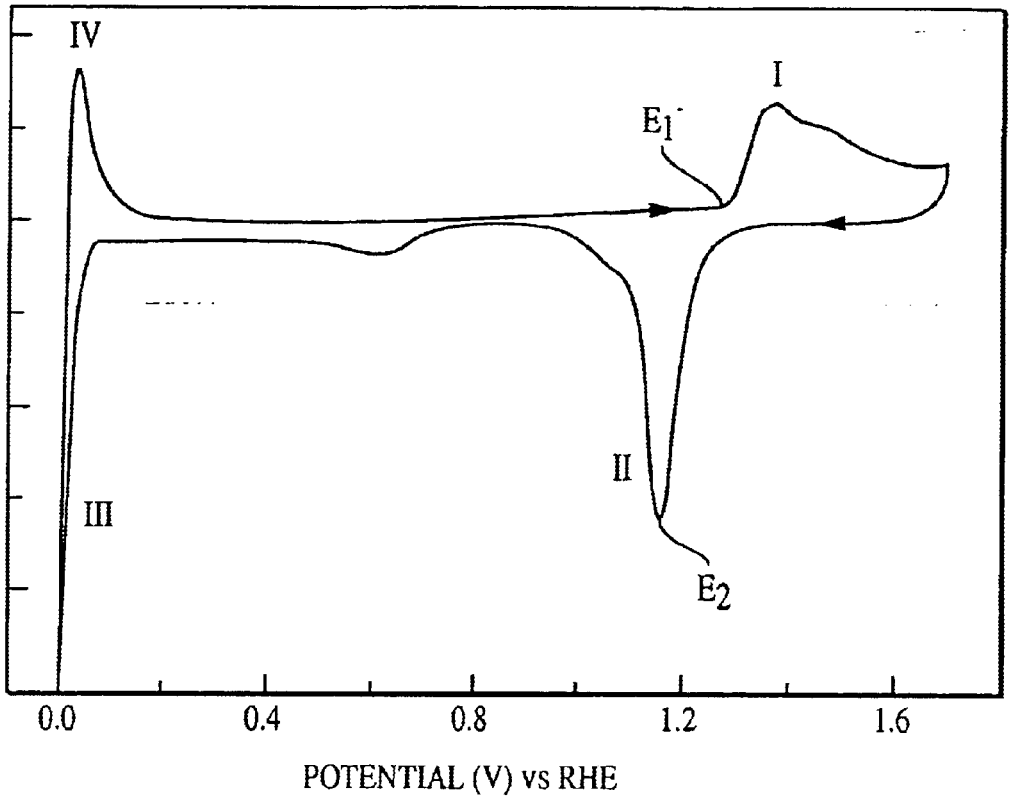
FIG. 1 is a voltammogram of a gold electrode produced via cyclic voltammatry according to one embodiment of the present invention.

According to certain embodiments, the present invention provides methods of producing an electrode capable of binding a thiol-binding analyte thereto comprising: providing a substrate capable of binding a dithiol molecule thereto; electrochemically treating the substrate to provide a treated substrate having a fractal dimension ($D_f$) of greater than about 2; and contacting said substrate with dithiol molecules to produce an electrode capable of binding a thiol-binding analyte to be detected thereto. As used herein, the term "binding" refers to the formation of a bond between any two moieties via covalent, ionic, hydrophobic, coulombic, hydrogen-bonding, or other bonding interactions.

Any suitable substrate may be provided according to the present invention to produce an electrode capable of binding a thiol-binding analyte thereto according to the present invention. The provided substrate preferably comprises a metal or non-metal material capable of bonding to at least one sulfur atom of a dithiol molecule. Examples of materials suitable for use in the substrates of the present invention include metals, such as, gold, platinum, silver, nickel, copper, stainless steel, alloys of two or more thereof, and the like, as well as, non-metals, such as, carbon (graphite), silicone, mixtures of two or more thereof, and the like. Certain preferred materials include metals such as gold and platinum.

The provided substrate may comprise any shape and dimensions suitable for binding dithiol molecules to the surfaces thereof to produce an electrode capable of binding an analyte to be detected thereto for any given sample in a particular application. Examples of suitable substrates according to the present invention may comprise wires, wire mesh, sheets, tabs, shavings, powder, combinations of two or more thereof, and the like. In certain preferred embodiments, the substrate comprises metal wire, metal wire mesh, or metal powder. In certain other preferred embodiments, the substrate comprises non-metal powder.

As discussed above, in certain preferred embodiments, the electrode produced from the substrate of the present invention has a $D_f$ of greater than about 2. In such embodiments, the substrate provided according to the present invention may have a fractal dimension of less than or greater than about 2, provided that the substrate is capable of producing a treated substrate having a fractal dimension of greater than about 2 after electrochemical treatment of the provided substrate according to the present invention. In certain preferred embodiments, applicants have recognized that certain advantages of the present invention are best exploited by providing a substrate having a fractal dimension ($D_f$) of greater than about 2. Certain preferred substrates having a $D_f$ greater than about 2 include metal powders, non-metal powders, wire mesh, substrates comprising a coiled wire (as discussed below) and combinations of two or more thereof.

Applicants have discovered that a number substrates comprising metal wires and having a $D_f$ greater than about 2 can be prepared, at least in part, by wrapping/coiling a metal wire around a metal support to form a coiled wire substrate. Any suitable metal wire as described above can be wrapped around a metal support to form a coiled wire substrate according to these preferred embodiments. In addition, any suitable metal support can be used. Examples of suitable metal supports include metal wires, wire mesh, sheets, tabs, rods combinations of two or more thereof, and the like. According to certain preferred embodiments, coiled metal wire substrates are prepared according to the present invention by wrapping a metal wire around another metal wire (as the support) having a larger diameter and preferably of the same metal. As will be recognized by those of skill in the art, the dimensions of the wires used according to the present invention are selected to provide a coiled wire substrate having the desired length and diameter for a given application. For example, applicants have prepared gold and platinum coiled wire substrates of about 1.5 to about 2.0 centimeters (cm) in length and having a diameter of about 0.2 cm by wrapping about 1 meter of a 100 micrometer ($\mu$m) diameter gold or platinum strand around one end of a 250 $\mu$m diameter gold or platinum support wire, respectively. The total length of the support wire is longer than 2.5 cm, and the portion of the support wire not wrapped with the thinner metal wire is insulated with Teflon tubing to expose only the wrapped end for cleaning and thiolation. Those of skill in the art will be readily able to adapt the procedure disclosed herein to provide coiled metal wire substrates of various dimensions and materials for use in the present invention.

In light of the disclosure herein, those of skill in the art will be readily able to provide a wide range of substrates suitable for producing an electrode according to the present invention without undue experimentation.

According to certain embodiments, the provided substrates are contacted with one or more fluids prior to being subjected to electrochemical treatment, such as cyclic voltammetry, to provide a treated substrate. Applicants have recognized that at least some amount of impurities capable of interfering with cyclic voltammetry and/or thiolation of the substrate surfaces, if present on the provided substrate, can be removed by contacting the substrate with one or more fluids prior to electrochemical treatment. Any of a wide range of fluids can be contacted with the substrates according to the present invention. Examples of suitable fluids include bases, such as ammonium hydroxide, and the like, acids, such as perchloric acid, and the like, and other fluids, such as, water, and the like, and combinations of two or more thereof. Certain preferred fluids include ammonium hydroxide, perchloric acid, water, and combinations of two or more thereof. Applicants have recognized, however, that certain salt and/or acid solutions which comprise halide or sulfate ions in solution (for example, sodium chloride, hydrogen chloride, sodium sulfate or sulfuric acid solutions) tend to be disfavored for use in contacting a substrate. Although applicants do not wish to be bound by or to any particular theory of operation, it is believed that halide and sulfate ions tend to adsorbed onto the substrate surface preventing effective thiolation of the surface.

Any suitable method for contacting a provided substrate with one or more fluids may be used in the present contacting step. For example, suitable methods include rinsing, dipping, or immersing the provided substrate in a fluid, passing a stream comprising one or more fluids over a substrate, combinations of two or more thereof, and the like. In certain preferred embodiments, the contacting step comprises immersing a substrate in the fluid to be contacted therewith. Any known method of immersing a substrate in a fluid can be adapted for use in the present invention. For example, in embodiments of the present invention wherein the fluid is in its liquid state, a substrate may be immersed therein by dipping at least a portion of the substrate in the solution. In embodiments wherein the fluid is in gaseous state, a substrate may be immersed by placing it in a sealable container, filling the container with the gaseous fluid, and sealing the container. Alternatively, a gaseous fluid stream may be passed across the substrate such that at least a portion of the substrate is immersed within the stream for a desired period of time. Those of skill in the art will be readily able to adapt the aforementioned procedures to the present invention without undue experimentation.

The contacting step of the present invention may comprise contacting the provided substrate with one fluid, or with two or more of the fluids described herein in series. The contacting step preferable comprises at least one step of contacting the substrate with the fluid in which the cyclic voltammetry step is to be conducted. In certain embodiments, the step of contacting the substrate with the fluid used in the cyclic voltammetry step is the last contacting step performed prior to cyclic voltammetry. For example, in certain embodiments wherein the substrate is a gold coiled wire substrate to be electrochemically treated in perchloric acid, the contacting step may comprise contacting the substrate with perchloric acid alone, or with ammonium hydroxide, water, and then perchloric acid in series.

The substrates provided according to the present invention are electrochemically treated, preferably via subjecting the substrates to cyclic voltammetry, to prepare the surfaces thereof for reaction with dithiol to produce an electrode. Applicants have recognized that cyclic voltammetry can be used to roughen the surface of a substrate causing an increase in the surface area thereof. Accordingly, substrates provided according to the present invention which exhibit $D_f$ values of either less than or greater than about 2 can be subjected to cyclic voltammetry to produce substrates having a $D_f$ of greater than about 2, or preferably, significantly greater than about 2, for use in thiolation as described herein. According to certain embodiments, the treated substrates produced via the present invention exhibit a $D_f$ of greater than about 2, preferably greater than about 2.1, and more preferably greater than about 2.2.

If desired, any suitable method for measuring the $D_f$ of a treated substrate produced according to the present invention can be used to determine such value. For example, the $D_f$ associated with a treated substrate may be measured using cyclic voltammetry data. Accordingly, procedures such as, for example, those described in "Effect of Partial Diffusion on Current-Time Transients and Throughputs for Reactions at Rough Electrodes" by R. Srinivasan and H. M. Saffarian, *Journal of Physical Chemistry B*, Vol. 106, 2002, pp. 7042–7047, incorporated herein by reference, may be used to determine $D_f$. In practice, the actual area and $D_f$ may vary between different electrodes, but will not affect the ability to thiolate their surfaces or capture and concentrate the analyte. It is not essential to determine the $D_f$ of each electrode before thiloation.

Cyclic voltammetry data can also be used to determine the actual surface area. The charge under the cathodic peak, due to the reduction of surface oxides on gold, is proportional to the real surface area of the electrode: 1 $cm^2$ area=~390±10 micro coulombs ("Real Surface Area Measurements in Electrochemistry" by S. Trasatti and O. A. Petrii, *Pure and Applied Chemistry*, Vol. 63, No. 5, 1991, pp. 711–734, incorporated herein by reference). A ratio of >>1 between actual surface area and the geometric area is indicative of a roughened surface suitable for thiolation.

As will be recognized by those of skill in the art, besides being used for cleaning, cyclic voltammetry, and in particular, the features of a cyclic voltammogram, are further used to identify a clean surface. For example, a cleaned platinum electrode will have cyclic voltammogram features similar or substantially the same as those shown in the figure (13.6.1) on page 570 of the book "Electrochemical Methods", Editors: A. J. Bard and L. R. Faulkner; (John Wiley and Sons, Inc., New York 2$^{nd}$ Edition (2001)) page 570. It is contemplated that any of a wide range of methods of subjecting substrates to cyclic voltammetry to clean and/or roughen the surfaces thereof known to those of skill in the art can be adapted for use according to the present invention.

For example, according to certain embodiments, applicants have prepared gold and platinum coiled wire substrates via cyclic voltammetry in 1 molar perchloric acid ($HClO_4$) using a scan rate of about 0.1 V/second and scanning over one or more potential ranges of from about −0.1V to about 2.10V and various ranges included therein, such as, for example, from about −0.05V to about 2.00V and from about 0.00V to about 1.70V. For example, a set of voltammetry steps used by applicants in such embodiments includes potential cycling of: from about −0.10V to about 2.10V for about 10 cycles, from about −0.05V to about 2.00V for about 10 cycles, and from about 0.00V to about 1.70V for about 5 cycles. Applicants have recognized that such conditions tend to produce relatively clean gold and platinum substrates, as evidenced by the voltammagrams produced therefrom. FIG. 1 shows an voltammagram obtained for a gold coiled wire subjected to the following voltammetry conditions according to one embodiment of the present invention: from about −0.10V to about 2.10V for about 10 cycles, from about −0.05V to about 2.00V for about 10 cycles, and from about 0.00V to about 1.70V for about 5 cycles. As shown in FIG. 1, the voltammagram has four peaks (labeled I to IV) that are related to various surface reactions that occur on the gold surface. Peak I is due to the formation of a monolayer of chemisorbed oxygen. The potential at which the oxygen adsorption commences is the main indicator of the cleanliness of the surface. The related potential (labeled $E_1$) is about 1.27V versus a Reversible Hydrogen Electrode, RHE (Pt/1M $HClO_4/H_2$ (1 atm) for a clean surface and is independent of the positive (1.7–2.1 or higher) or negative (0 to −0.1 or lower) limits of potential used during scanning. The presence of adsorbed impurities will push the oxygen adsorption to more positive values than 1.27V, and will shift the location of peak I to a more positive potential. Peak II in the reverse (negative) scan of the voltammetry is related to the reduction of the adsorbed oxygen that occurred during the forward scan. Unlike, peak I, the position of peak II and its associated area depends upon the positive potential limit used in the forward scan. As shown in FIG. 1, if the potential is reversed at 1.7 V, then peak II appears at $E_2$=1.16V. The area under peak II is used for the calculation of the real surface area of the electrode. Peaks III and IV are due to the reduction of $H^+$ ion and subsequent oxidation of hydrogen to $H^+$ ion.

According to certain preferred embodiments, it is preferred that a treated gold coiled wire substrate of the present invention exhibit voltammagram characteristics similar to those shown in FIG. 1 when subjected to the cyclic voltammetry procedure described above. For example, it is preferred that cleaned gold substrates produce a voltammagram having an $E_1$ peak at from aboutm 1.26 V to about 1.28 V, preferably from about 1.265 V to about 1.275 V, and most preferably, about 1.27 V when subjected to voltammetry conditions similar to those described above. In addition, it is preferred that the voltammagram exhibit an $E_2$ peak at from about 1.15 V to about 1.17 V, preferably from about 1.155 V to about 1.165 V, and most preferably, about 1.16V when the potential is reversed at 1.7 V.

In certain embodiments, gold and platinum electrodes produced according to the procedure described hereinabove were subjected to further potential cycling to assure the surfaces thereof were prepared for reaction with dithiol molecules. For example, certain gold and platinum electrodes exhibiting the desired voltammagram characteristics were subjected to voltammetry conditions such as, for example, from about −0.05V to about 2.00V for about 10 cycles and/or from about 0.00V to about 1.70V for about 5 cycles.

According to certain preferred embodiments, after a suitable treated substrate has been produced via cyclic voltammetry, but before such electrode is removed from the voltammetry solution, it is desirable to polarize the electrode to produce an oxide/hydroxide layer on at least a portion of the substrate surface, preferably the entire surface, when removed. In certain embodiments, the treated electrode is polarized at a voltage of from about 1.99 V to about 2.01V, preferably from about 2.0V for a suitable time prior to removing the substrate from the voltammetry solution. Suitable times of polarization include from about 10 seconds to about 2 minutes, preferably from about 20 seconds to about 1 minute, and more preferably about 30 seconds.

In light of the disclosure herein, those of skill in the art will be able to select and adapt cyclic voltammetry procedures suitable for use with the methods described herein to produce a wide range of metal and/or non-metal treated substrates having a $D_f$ greater than about 2 and capable of binding with dithiols according to the present invention to produce stable electrodes without undue experimentation.

According to certain preferred embodiments, the treated substrates produced according to the present invention are washed to remove acid present on the substrate prior to thiolation. Preferably, the substrates are washed via a procedure comprising rinsing and sonicating the treated substrate in water one or more times, and rinsing and sonicating the substrate in the solvent to be used in the subsequent thiolation step one or more times (suitable thiolation solvents are discussed below). By way of example, in certain embodiments wherein the treated substrate was produced via voltammetry in perchloric acid and is to be thiolated in the presence of an isopropanol solvent, the substrate was washed via a procedure comprising: rinsing the treated substrate with water, sonicating the treated substrate in water, and repeating one or more of the rinsing and sonicating in water steps, followed by, rinsing the treated substrate in isopropanol, sonicating the treated substrate in isopropanol, and repeating one or more of the rinsing and sonicating in isopropanol steps. Those of skill in the art will be readily able, in light of the disclosure herein, to wash a treated substrate in preparation for thiolation according to the present invention.

The present invention comprises contacting a treated substrate with at least one dithiol compound to bond said dithiol compound to the surface of said treated substrate. Any of a wide range of dithiol compounds may be used according to the present invention. Examples of suitable dithiol compounds include compounds of the formula I:

$$HS—[CH_2]_n—SH \quad (I)$$

wherein n is from about 2 to about 10. Certain preferred compounds of formula I have an n of from about 2 to about 8.

Any suitable method for contacting a treated substrate with one or more dithiol compounds may be adapted for use according to the present methods. Preferably, the method of contacting allows for contacting substantially the entire surface of the electrode and allows for substantially the complete thiolation of the surface thereof. For example, suitable methods include immersing the treated substrate in a dithiol compound solution, passing a stream comprising one or more dithiol compounds over a treated substrate, combinations of two or more thereof, and the like. In certain preferred embodiments, the contacting step comprises immersing a treated substrate in a solution of the dithiol compound to be bonded thereto. Any known method of immersing a substrate in a fluid can be adapted for use in the present invention. For example, in embodiments of the present invention wherein the dithiol compound solution is a fluid in its liquid state, a treated substrate may be immersed therein by dipping at least a portion of the substrate in the solution. In embodiments wherein the dithiol compound solution is a fluid in gaseous state, a treated substrate may be immersed by placing it in a sealable container, filling the container with gaseous dithiol solution, and sealing the container. Alternatively, a gaseous dithiol solution stream may be passed across a treated substrate such that at least a portion of the substrate is immersed within the stream for a desired period of time. Those of skill in the art will be readily able to adapt the aforementioned procedures to the present invention without undue experimentation.

The dithiol solutions for use in the present invention may comprise any suitable solvent and any suitable concentration. Preferably, the concentration of dithiol in the solution is sufficient to allow complete thiolation of the surface(s) of the treated substrate. Examples of suitable solvents include organic solvents that dissolve dithiol without chemically reaction with dithiol, such as, isopropanol, acetone, carbon tetrachloride, dimethyl formamide (DMF), dimethyl sulfoxide (DMSO), and the like. Certain preferred solvents include isopropanol. Examples of suitable concentrations of dithiol in solution include from about 0.005 to 0.5 molar (M), preferably from about 0.01 to 0.02 M, and even more preferably from about 0.01 to about 0.015 M dithiol.

Those of skill in the art will recognize that the conditions, including flow rate, temperature, pressure and time period, under which an article is immersed in a dithiol solution according to preferred embodiments of the present invention will vary depending on a number of factors including the concentration of the dithiol solution and the substrate used. For example, in certain preferred embodiments wherein the treated substrate is a gold or platinum coiled wire substrate (the wrapped portion being about 2.0 cm in length and about 0.2 cm in diameter) and the dithiol solution has a concentration of from about 0.01 to about 0.02 M, the time of immersion is from about 1 hour to about 1 week, preferably from about 5 hours to about 1 week, and even more preferably from about 5 hours to about 2 days. In light of the disclosure herein, one of ordinary skill in the art will be readily able to optimize immersion conditions for use in the present invention to achieve thiolation of the treated substrate surfaces without undue experimentation.

After reaction with dithiol, the electrode produced according to the present invention may be washed to remove unreacted dithiol or solvent from the electrode to prevent interference of such unreacted/excess chemicals with the attachment of heme, or other detectable thiol-binding analytes, thereto. Any suitable washing step(s) can be used to remove unreacted/excess chemicals, introduced to the substrate via thiolation, from the substrate. For example, the substrate may be washed, rinsed, and/or immersed in any of a wide range of fluids including isopropanol, acetone, carbon tetrachloride, dimethyl formamide, dimethyl sulfoxide. Preferably, the fluid for use in washing comprises the same fluid used in the thiolation step as solvent.

The electrodes produced according to the above methods can be used to great advantage in the accumulation and detection of a wide range of analytes capable of binding to a dithiol moiety (thiol-binding analytes). Examples of moieties capable of being accumulated on, and detected using, the present electrodes include heme, hemoglobin, cytochrome c, and the like. It has been recognized that many of the advantages of the present invention are best exploited in the detection of heme in target samples.

Due to their relative stability, the electrodes produced according to the present methods can be stored for a period of time prior to their use in accumulation and detection. In certain other embodiments, the produced electrodes are transferred without substantial delay from the thiolation and/or washing steps described above to a sample for detection of analytes therein.

Any of a wide variety of methods for contacting an electrode of the present invention with a sample comprising an analyte to be tested, i.e., in certain preferred embodiments, one or more heme molecules, can be adapted for use herein. For example, any of the aforementioned methods for contacting a treated substrate with a fluid can be adapted to contact an electrode with a sample fluid to accumulate an analyte onto the electrode according to the present invention.

Figure 2:
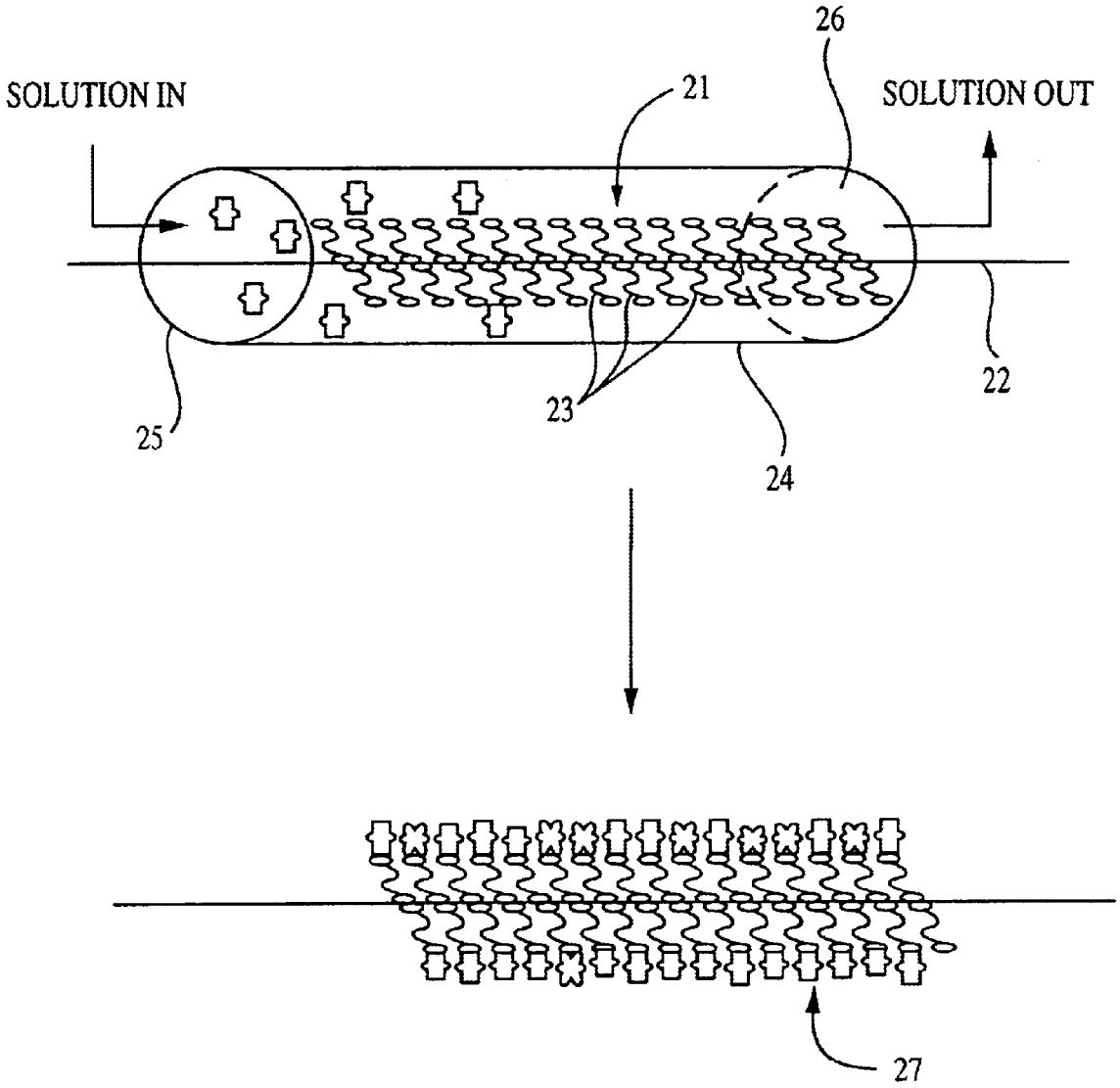
FIG. 2 shows an electrode positioned within a capillary for use in accumulating an analyte onto the electrode according to one embodiment of the present invention.

In certain preferred embodiments, the electrode and sample fluid are contacted by immersing the electrode in the sample fluid. For example, according to certain preferred embodiments, an electrode of the present invention can be configured within a capillary as shown in FIG. 2 to immerse an electrode in a sample solution. In FIG. 2 (schematic, not drawn to scale) an electrode 21, comprising a 50 micron diameter gold wire 22 having dithiol molecules, 23, bound thereto is placed within a 100-micron-diameter capillary tube, 24. In operation, a sample solution comprising one or more analyte molecules, i.e. heme molecules, is passed through one end 25 of the capillary, over electrode 21 wherein heme is bonded thereto to form an electrode 27 having heme molecules attached thereto, and the unbound sample solution is then removed through end 26. By passing the sample solution through the capillary, the process of attaching analyte to the electrode tends to be accelerated, and less time is need to accumulate analyte onto the electrode.

Figure 3:
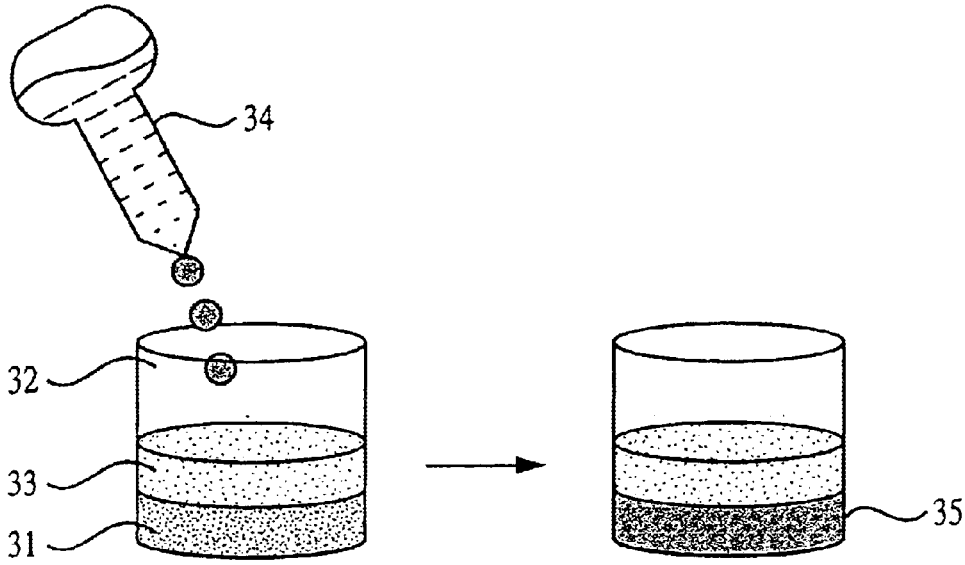
FIG. 3 shows a wire-mesh electrode for use in accumulating an analyte according to one embodiment of the present invention.

Another method for immersing an electrode in a sample solution to accumulate analyte onto the electrode according to certain preferred embodiments comprises immersing a wire mesh electrode in a glass tube as shown in FIG. 3. In FIG. 3, a wire mesh electrode 31 is placed in glass tube 32, and under a filter 33 also positioned within tube 32. In operation, a fluid sample containing analyte is dropped into the glass tube, for example via a dropper 34 as shown in FIG. 3, wherein particles other than the analyte which are larger than the pore size of filter 33 stay above filter 33 and are removed through subsequent washing. Analyte molecules, such as heme, pass through filter 33 and are bound to electrode 31 to form an electrode 35 having heme bound thereto. Any suitable filter may be used in such preferred embodiments. In certain embodiments wherein the analyte comprises heme, it is preferred to use a glass frit filter through which heme can pass. By choosing an appropriate pore size for the glass frit, this approach offers the advantage of being able to filter large particles and even some biological molecules such as proteins from attaching to the thiolated metal surface.

In certain embodiments, it is desirable to reduce the amount of oxygen present in the analyte solution during the contacting and accumulating steps. Accordingly, in certain preferred embodiments, the contacting steps according to the present invention comprise bubbling an inert gas, such as nitrogen, through the sample being tested when contacting the electrode.

Once analyte molecules are attached to the electrode surface, the electrode can be advantageously removed from the parent solution and immersed in another solution (such as a potassium chloride or sodium chloride solution) to remove non-absorbed analyte molecules according to certain embodiments. Due to the relative stability of the present electrodes, the present electrodes having analytes attached thereto can be left out in air for as long as 15–20 hours or longer without the degradation of the electrode surface or the analyte attached thereto. Accordingly, such electrodes allow for the transport of molecules attached thereto to other locations for testing and detection of the analyte.

The detection of the analyte accumulated on an electrode according to the present methods is achieved via any of a wide variety of detection methods. For example, in certain embodiments, the electrode having analyte accumulated thereon is transferred to an electrochemical cell wherein the accumulated analyte is detected using a variety of known chemical, electrochemical, optical, and/or biochemical techniques, such as, cyclic voltammetry, differential pulse voltammetry, impedance (electrochemical impedance spectroscopy, harmonic analysis), chronoamperometery, chronovoltammetry, combinations of two or more thereof, and the like.

While any of such electrochemical methods can be readily adapted for use herein, applicants have recognized that certain reference electrodes are disfavored for use in detecting analytes according to the present invention. In particular, applicants have recognized that silver-based or mercury-based electrons tend to provide silver and mercury ions in solution which may interfere with accurate detection of analytes. The amount of silver or mercury ions needed to poison the surface of an electrode may be measured in units as small as pico-molar. Applicants have recognized, however, that before the analyte is attached to thiol, trace amounts of silver or mercury ions, if present in the solution, may attach to the dithiol molecules on the thiolated gold surface, thus "poisoning" the thiolated surface. Once silver or mercury ions are attached to the thiol molecules on the thiolated surface, the desired analyte molecules are not able to attach to and accumulate on the surface. However, if the thiolate surface is first exposed to the solution containing the analyte molecules, then the silver or mercury ions are less likely to attach to the thiolated surface. Thus, the use of a silver or mercury based reference electrode may be viable according to the present invention provided that the detection process is completed within a few minutes after introducing the electrode having analytes attached thereto to an electrochemical cell. In certain preferred embodiments, to avoid the introduction of silver or mercury ions to solution, other non-silver or non-mercury electrodes, such as, a reversible hydrogen reference electrode is used for detection.

Furthermore, the aforementioned electrochemical detection techniques tend to be less sensitive to analytes in the presence of oxygen in the sample. According to certain embodiments, to improve the sensitivity of such techniques it is desirable to remove oxygen from (de-aerate) the medium in which the analyte is to be detected. Any of a wide variety of methods for de-aerating the medium of detection can be used according to the present methods. For example, in certain embodiments, the medium may be de-aerated by sparging the medium with nitrogen gas or by adding sodium nitrite thereto.

According to certain alternative embodiments, the electrode having an analyte bonded thereto can be immersed in a solvent to produce an analyte solution which can be analyzed using mass spectrometry and other known analytical techniques. In this manner, the analyte present in a sample solution can be transferred to another container with a much smaller volume to form a test solution wherein the concentration of analyte is higher than its original sample solution, and therefore, more readily detectable.

Any solvent suitable for solvating an analyte to be detected can be used according to the present invention. For example, for methods of detecting heme, suitable solvents include ammonium hydroxide, sodium hydroxide, potassium hydroxide, mixtures of two or more thereof, and the like.

According to certain embodiments, the detection methods of the present invention can be used to detect the concentrations of thiol-binding analytes in two or more samples solutions having the same or different concentrations of analytes therein. For example, if there are multiple samples suspected of containing thiol-binding analytes, one or more wires can be contacted with each sample to accumulate analyte thereon, and each wire can be tested according to the present invention for thiol-binding analytes. Any of the above methods can be used to test one or more of the wires used to test multiple samples. For example, a single electrochemical detector, or a plurality of detectors, can be used to test each wire for analytes. Alternatively, the thiol-binding analytes from each of the plurality of wires is dissolved in a separate container comprising an analyte solvent, to form a plurality of solutions which can be tested via mass spectroscopy, and the like.

EXAMPLES

Example 1

This example illustrates the preparation of a gold wire electrode capable of accumulating heme thereon according to one embodiment of the present invention.

About 1 meter of a 100-micrometer-diameter gold wire is wrapped around 1.5 to about 2.0 cm of one end of a gold wire support, the wire support having a total length of longer than about 2.5 cm and a diameter of about 250 micrometers, to form a gold coiled wire substrate. The resulting wrapped end has a diameter of about 0.2 cm. The unwrapped portion of the wire support is insulated with a dual, heat-shrink/melt type Teflon tubing, exposing only the wrapped end for thiolation.

The gold coiled wire substrate is rinsed and dipped in a 2 molar solution of ammonium hydroxide for 5 minutes, then rinsed with de-ionized water and immersed in a 1 molar perchloric acid solution for 5 minutes. The cleaned substrate is then treated electrochemically in 1 molar perchloric acid by potential cyclic (Cyclic Voltammetry) as follows to produce a treated substrate: using a potential scan rate of 0.1V/second, the substrate is scanned (a) from about −0.10V to about 2.10V for about 10 cycles, (b) from about −0.05V to about 2.00V for about 10 cycles, and then (c) from about 0.00V to about 1.70V for about 5 cycles to obtain a voltammagram similar to that shown in FIG. 1. Then the substrate is scanned again from about −0.05V to about 2.00V for about 5 cycles, and from about 0.00V to about 1.70V for about 5 cycles to ensure surface cleanliness. The resulting treated substrate is then polarized at about 2.0V for about 30 seconds and is removed while the 2.0V potential is still on the substrate.

The polarized, treated substrate is rinsed with copious amounts of water to remove traces of perchloric acid from the substrate surface. The treated substrate is placed in a test tube filled with water and sonicated for 30 seconds. The treated substrate is then removed, rinsed with water, and sonicated again in water for 30 seconds. The treated substrate is rinsed with water and rinsed with high purity isopropanol, then sonicated in a test tube filled with isopropanol. The substrate is rinsed and sonicated with isopropanol again.

The treated substrate is then rinsed with isopropanol and placed into about 1 mL of about 10 mM solution of $HS(CH_2)_4SH$ for from about 5 hours to about 2 days to produce an electrode suitable for accumulating heme thereon.

Example 2

This example illustrates the preparation of a platinum wire electrode capable of accumulating heme thereon according to one embodiment of the present invention.

About 1 meter of a 100-micrometer-diameter platinum wire is wrapped around 1.5 to about 2.0 cm of one end of a platinum wire support, the wire support having a total length of longer than about 2.5 cm and a diameter of about 250 micrometers, to form a platinum coiled wire substrate. The resulting wrapped end has a diameter of about 0.2 cm. The unwrapped portion of the wire support is insulated with a dual, heat-shrink/melt type Teflon tubing, exposing only the wrapped end for thiolation.

The platinum coiled wire substrate is rinsed and dipped with a 2 molar solution of ammonium hydroxide for 5 minutes, then rinsed with de-ionized water and immersed in a 1 molar perchloric acid solution for 5 minutes. The cleaned substrate is then treated electrochemically in 1 molar perchloric acid by potential cyclic (Cyclic Voltammetry) to produce a treated platinum electrode having a fractal dimension of greater than about 2 and exhibiting voltammagram properties similar to cleaned platinum electrode voltammagrams known in the art, for example, as described in Electrochemical Methods, $2^{nd}$ Edition, Editors: A. J. Bard and L. R. Faulkner; John Wiley and Sons Inc., New York, 2001, ISBN:0-471-04372-9, page 570. The resulting treated substrate is then polarized at about 2.0V for about 30 seconds and is removed while the 2.0 V potential is still on the substrate.

The polarized, treated substrate is rinsed with copious amounts of water to remove traces of perchloric acid from the substrate surface. The treated substrate is placed in a test tube filled with water and sonicated for 30 seconds. The treated substrate is then removed, rinsed with water, and sonicated again in water for 30 seconds. The treated substrate is rinsed with water and rinsed with high purity isopropanol, then sonicated in a test tube filled with isopropanol. The substrate is rinsed and sonicated with isopropanol again.

The treated substrate is then rinsed with isopropanol and placed into about 1 mL of an about 10 mM solution of $HS(CH_2)_4SH$ for from about 5 hours to about 2 days to produce an electrode suitable for accumulating heme thereon.

Example 3

This example illustrates the accumulation of heme (hematin) onto electrodes and detection thereof using cyclic voltammetry according to one embodiment of the present invention.

Four samples solutions (A–D) containing respective concentrations of 0M, 10 nM, 180 nM, and 5 micromolar heme are prepared. One of four electrodes produced according to Example 1 is independently immersed in each sample solution for about 30 to about 60 minutes. While each electrode is immersed, nitrogen is bubbled through the test solution.

Figure 4:
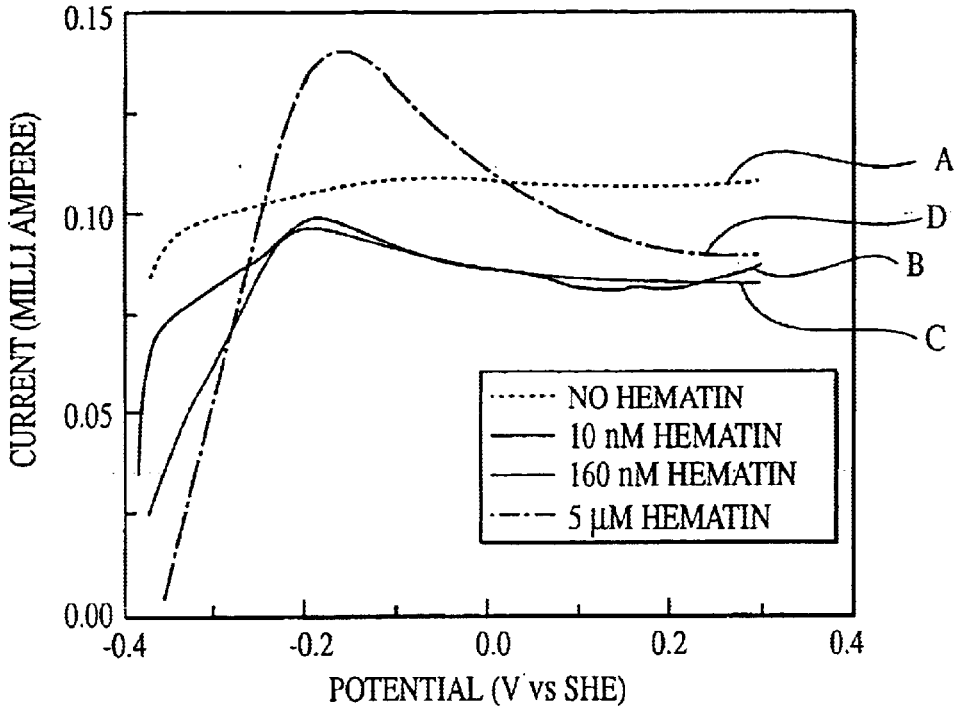
FIG. 4 is a voltammogram showing the graphs of four heme samples detected using voltammetry according to certain embodiments of the present invention.

After accumulation (or not) of heme onto an electrode, the electrode is transferred to an electrochemical cell comprising a background electrolyte of deaerated aqueous solution of 0.1M KCl (potassium chloride)+10 mM 4-(2-Hydroxyethyl)-1-piperazine-ethanesulfonic acid (HEPES)+0.3% v/v DMSO, the pH of which is adjusted to 7.5 by addition of concentrated aqueous potassium hydroxide solution. The amount of heme on the electrode surface is detected using cyclic voltammetry (with a scan rate of 10 V/s). The voltammetry data for samples A–D was collected and plotted to obtain the graph shown in FIG. 4. In FIG. 4, the peaks seen at about −0.2V correspond to the oxidation of Fe(II) within the heme molecules to Fe(III). These redox species are bound to the electrode surface and the heights of the peaks are proportional to the surface heme concentration.

Example 4

This example illustrates the accumulation of heme (hematin) onto electrodes and detection thereof using differential pulse voltammetry according to one embodiment of the present invention.

Three samples solutions (E–G) containing respective concentrations of 10 nM, 500 nM, and 5 micromolar heme are prepared. One of three electrodes produced according to Example 1 is independently immersed in each sample solution for about 30 to about 60 minutes. While each electrode is immersed, nitrogen is bubbled through the test solution.

Figure 5:
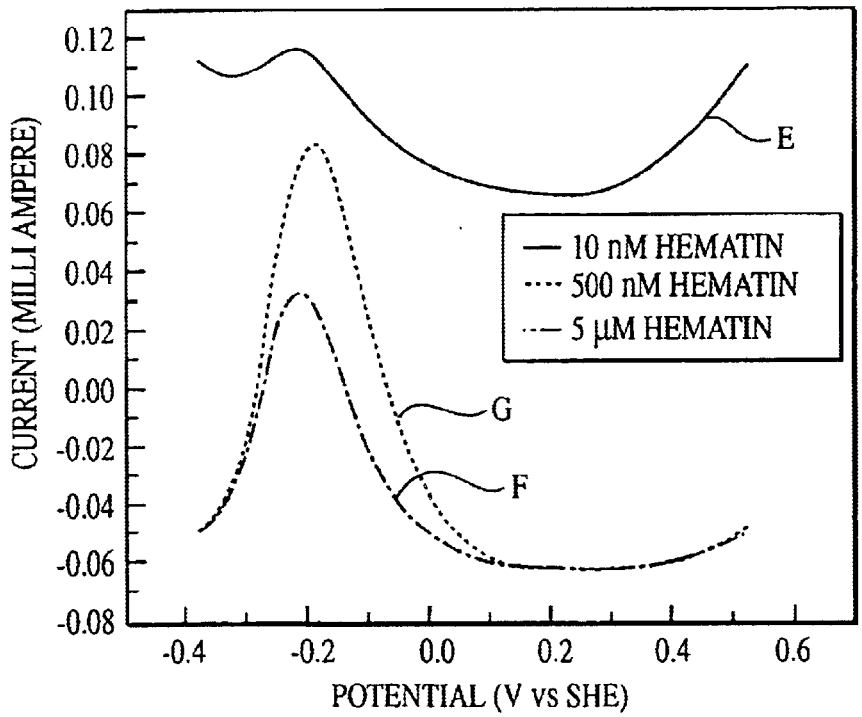
FIG. 5 is a voltammogram showing the graphs of three heme samples detected using differential pulse voltammetry according to certain embodiments of the present invention.

After accumulation of heme onto an electrode, the electrode is transferred to an electrochemical cell comprising a background electrolyte of deaerated aqueous solution of 0.1M KCl (potassium chloride)+10 mM HEPES+0.3% v/v DMSO and the amount of heme on the electrode surface is detected using differential pulse voltammetry (with a scan rate of 2 V/s). The voltammetry data for samples E-G was collected and plotted to obtain the graph shown in FIG. 5. In FIG. 5, the peaks seen at about −0.2V correspond to the oxidation of Fe(II) to Fe(III), both within the heme molecules. These redox species are bound to the electrode surface and the heights of the peaks are proportional to the surface heme concentration.

Example 5

This example illustrates the accumulation of heme (hematin) onto electrodes and detection thereof using mass spectroscopy according to one embodiment of the present invention.

Figure 6:
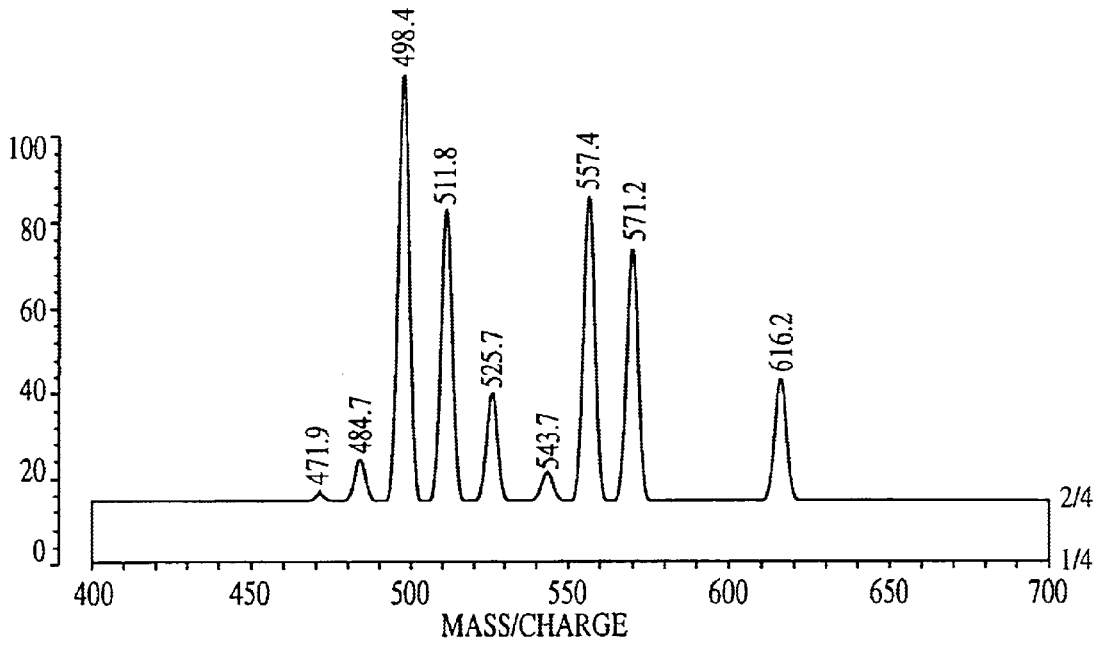
FIG. 6 is a mass spectrum of a heme sample detected according to one embodiment of the present invention.

An electrode produced according to Example 1 was immersed in a sample solution suspected of containing heme for 30 to 90 minutes. The electrode was then removed from the sample solution, washed with water, and immersed in an ammonium hydroxide solution to remove heme. The laser desorption time-of-flight mass spectrum of the ammonium hydroxide solution containing heme produced the graph shown in FIG. 6 evidencing the presence of heme therein (parent cation radical m/z 616, attendant fragment ions m/z 571, 557, 544, 526, 512, 498, 485). The instrument used was the Kratos Kompact Discovery mass spectrometer (positive ionization, linear modes).

What is claimed is:

1. A method of producing an electrode capable of binding an analyte thereto comprising:

providing a substrate capable of binding a dithiol molecule thereto;

electrochemically treating said substrate using cyclic voltammetry to provide a treated substrate having a fractal dimension of greater than about 2; and contacting said treated substrate with dithiol molecules to produce an electrode having dithiol groups attached thereto and capable of binding an analyte to be detected thereto.

2. The method of claim 1 wherein said provided substrate comprises a metal capable of bonding to the sulfur atom of a thiol compound.

3. The method of claim 2 wherein said metal is selected from the group consisting of gold, platinum, silver, nickel, copper, stainless steel, and alloys of two or more thereof.

4. The method of claim 2 wherein said metal comprises a metal selected from the group consisting of gold and platinum.

5. The method of claim 2 wherein said provided substrate is selected from the group consisting of metal wire and metal powder.

6. The method of claim 2 wherein said provided substrate is a coiled metal wire substrate.

7. The method of claim 2 wherein said provided substrate is a wire mesh substrate.

8. The method of claim 2 wherein said provided substrate comprises a non-metal powder.

9. The method of claim 1 further comprising the step of contacting the substrate, prior to the electrochemical treament step, with one or more fluids to prepare the surfaces thereof for electrochemical treatment.

10. The method of claim 9 wherein said contacting step comprises contacting the substrate with a fluid selected from the group consisting of potassium hydroxide, ammonium hydroxide, water, perchloric acid, and combinations of two or more thereof.

11. The method of claim 9 wherein said contacting step comprises contacting the substrate with ammonium hydroxide, then water, and then perchloric acid.

12. The method of claim 1 wherein said treated substrate has a fractal dimension of greater than about 2.1.

13. The method of claim 1 wherein said treated substrate has a fractal dimension of greater than about 2.2.

14. The method of claim 1 further comprising the step of polarizing the treated substrate before such substrate is removed from any solution in which cyclic voltammetry is conducted.

15. The method of claim 14 wherein said treated substrate is polarized at a voltage of about 2.0 volts for about 30 seconds.

16. The method of claim 1 further comprising the step of washing the treated substrate with one or more fluids prior to contacting the treated substrate with dithiol molecules.

17. The method of claim 16 wherein said washing step comprises rinsing the treated substrate in a fluid, sonicating the treated substrate while immersed in a fluid, or combinations of two or more thereof.

18. The method of claim 1 wherein said dithiol molecules are described by the formula I:

$$HS—[CH_2]_n—SH \quad (I)$$

wherein n is from about 2 to about 10.

19. The method of claim 18 wherein n is from about 2 to about 8.

20. The method of claim 1 wherein said analyte to be detected is heme.

21. The method of claim 1 wherein said analyte to be detected is hemoglobin.

22. The method of claim 1 wherein said analyte to be detected is cytochrome c.

23. A method of accumulating an analyte from a target sample onto an electrode comprising:

providing an electrode produced according to claim 1; and contacting said electrode with a target sample comprising an analyte capable of bonding to a dithiol moiety to bond at least a portion of said analyte to said electrode.

24. The method of claim 23 wherein said contacting step comprises positioning the provided electrode in a capillary tube and passing the target sample through the capillary tube to contact the electrode.

25. The method of claim 23 wherein said contacting step comprises positioning the electrode in a glass tube and under a glass filter within the tube and passing the target sample through the glass filter and into contact with the electrode.

26. The method of claim 25 wherein said provided electrode comprises wire mesh.

27. The method of claim 23 wherein said contacting step comprises bubbling nitrogen through the target sample for at least a portion of the contacting step.

28. The method of claim 23 wherein said analyte is heme.

29. A method of detecting an analyte comprising:

providing an electrode produced according to claim 1;

contacting said electrode with a target sample comprising an analyte capable of binding to a dithiol moiety to bind at least a portion of said analyte to said electrode; and detecting the analyte bonded to the electrode.

30. The method of claim 29 wherein said analyte is detected using cyclic voltammetry or differential pulse voltammetry.

31. The method of claim 30 wherein said analyte is detected using mass spectroscopy.

32. The method of claim 30 wherein said analyte is heme.

33. The method of claim 32 wherein said target sample has a concentration of less than about 2 nanmolar to greater than about 10 micromolar.

* * * * *